US006846223B2

(12) United States Patent
Conley et al.

(10) Patent No.: US 6,846,223 B2
(45) Date of Patent: Jan. 25, 2005

(54) ABRASIVE WHEELS WITH WORKPIECE VISION FEATURE

(75) Inventors: Karen M. Conley, Amesbury, MA (US); Janet L. Hammarstrom, Auburn, MA (US); Bruce E. Vigeant, Oxford, MA (US)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 0 days.

(21) Appl. No.: 09/796,941

(22) Filed: Mar. 2, 2001

(65) Prior Publication Data

US 2004/0009744 A1 Jan. 15, 2004

Related U.S. Application Data

(60) Provisional application No. 60/254,478, filed on Dec. 8, 2000.

(51) Int. Cl.[7] ..... B24B 49/12
(52) U.S. Cl. ..... 451/6; 451/541
(58) Field of Search ..... 451/6, 359, 353, 451/548, 541; 125/15

(56) References Cited

U.S. PATENT DOCUMENTS

| | | | |
|---|---|---|---|
| 1,979,905 | A | 11/1934 | Rogerson |
| 2,082,916 | A | 6/1937 | Stratford |
| 2,749,681 | A | 6/1956 | Reidenbach |
| 3,385,010 | A | 5/1968 | Vorce et al. |
| 3,443,343 | A | 5/1969 | Pratt |
| 3,986,303 | A | 10/1976 | Coes, Jr. |
| 4,685,181 | A | 8/1987 | Schwartz |
| 5,040,341 | A | 8/1991 | Okinaga |
| 5,287,662 | A | 2/1994 | Weis et al. |
| 5,697,359 | A | 12/1997 | Okanishi et al. |
| 5,871,005 | A | 2/1999 | Sueta |
| 5,876,470 | A | 3/1999 | Abrahamson |
| 5,895,317 | A | 4/1999 | Timm |
| 6,007,415 | A | 12/1999 | Van Osenbruggen |
| 6,062,965 | A | 5/2000 | Knowlton |
| 6,077,156 | A | 6/2000 | Amin et al. |
| 6,159,089 | A | 12/2000 | Amin et al. |

FOREIGN PATENT DOCUMENTS

| | | | |
|---|---|---|---|
| FR | 1 085 962 | A | 2/1955 |
| GB | 377 291 | A | 7/1932 |
| JP | 60-203892 | | 12/1985 |
| JP | 60-204277 | | 12/1985 |
| JP | 61-177240 | | 11/1986 |
| JP | S62-123865 | | 8/1987 |

OTHER PUBLICATIONS

Geo.H.Bullard Co., Inc. Advertisement in "Grinding and Finishing", vol. 13, No. 1. Hitchcock Publishing Company, Jan. 1967.

Bosch (Norway) Photocopy of a package for a metal wheel with grain adhered on the rim of the grinding surface and holes spaced along the metal core to allow vision. (undated).

*Primary Examiner*—Robert A. Rose
(74) *Attorney, Agent, or Firm*—Mary E. Porter; Sampson & Associates

(57) ABSTRACT

Abrasive grinding wheels having an irregular (i.e., gapped) perimeter shape and/or holes extending therethrough permit one to view the surface of a workpiece being ground in conventional surface finishing, snagging and/or weld blending operations. The grinding wheels may each include one or more gaps disposed in spaced relation about the otherwise circular perimeter of the wheel. Holes also may be provided in addition to, or in lieu of, the gaps, and similarly spaced equidistantly about the wheel. The gaps and/or holes may be configured in many diverse shapes. Gap and hole positions may be selected so as to retain the balance of the wheel. Advantageously, when the wheels are rotated about their axes, one is able to monitor the condition of the surface of the workpiece as it is being abraded, without removing the grinding wheel from the surface.

49 Claims, 14 Drawing Sheets

ABRASIVE WHEELS WITH WORKPIECE VISION FEATURE

RELATED APPLICATION

This application claims the benefit of U.S. Provisional Application Ser. No. 60/254,478, filed Dec. 8, 2000.

BACKGROUND OF THE INVENTION

1. Field of the Invention

This invention relates to the field of abrasive or grinding wheels, and in particular this invention relates to grinding wheels that facilitate observation of a workpiece during grinding.

2. Background Information

Abrasive (i.e., grinding) wheels are widely used on conventional grinding machines and on hand-held angle grinders. When used on these machines the wheel is held by its center and is rotated at a relatively high speed while pressed against the work (i.e., workpiece). The abrasive surface of the grinding wheel wears down the surface of the work by the collective cutting action of abrasive grains of the grinding wheel.

Grinding wheels are used in both rough grinding and precision grinding operations. Rough grinding is used to accomplish rapid stock removal without particular concern for surface finish and burn. Examples of rough grinding include the rapid removal of impurities from billets, the preparing of weld seams and the cutting off of steel. Precision grinding is concerned with controlling the amount of stock removed to achieve desired dimensional tolerances and/or surface finish. Examples of precision grinding include the removal of precise amounts of material, sharpening, shaping, and general surface finishing operations such as polishing, and blending (i.e., smoothing out weld beads).

Conventional face grinding wheels or surface grinding wheels, in which the generally planar face of the grinding wheel is applied to the workpiece, may be used for both rough and precision grinding, using a conventional surface grinder or an angle grinder with the planar face oriented at an angle up to about 6 degrees relative to the workpiece. An example of a surface grinding operation is the grinding of a fire deck of a bimetallic engine block, such as disclosed in U.S. Pat. No. 5,951,378. Conventional face grinding or surface grinding wheels are often fabricated by molding an abrasive particulate and bond mixture, with or without fiber reinforcements, to form a rigid, monolithic, bonded abrasive wheel. An example of suitable bonded abrasive includes alumina grain in a resin bond matrix. Other examples of bonded abrasives include diamond, CBN, alumina, or silicon carbide grain, in a vitrified or metal bond. Various wheel shapes as designated by ANSI (American National Standards Institute) are commonly used in face or surface grinding operations. These wheel types include straight (ANSI Type 1), cylinder wheels (Type 2), recessed (Types 5 and 7), straight and flaring cup (Types 10 and 11), dish and saucer wheels (Types 12 and 13), relieved and/or recessed wheels (Types 20 to 26) and depressed center wheels (Types 27, 27A and 28). Variations of the above wheels, such as ANSI Type 29 wheels, may also be suitable for face or surface grinding.

A drawback associated with conventional face grinding or surface grinding wheels is that the operator cannot see the surface of the workpiece being ground during the actual operation; the operator can only see material that is not covered by the wheel. It is often difficult to carry out a precise operation without repeatedly inspecting the work in progress to more closely reach an approximation to the desired result. Hand-held tools such as angle grinders, cannot be re-applied precisely so that repeated inspection is not a good option for careful work.

A wheel having perforations becomes semi-transparent when spun at a moderate to high speed because of the persistence of image on the retina in the human eye; the "persistence of vision" effect. The image seen through a perforated spinning wheel is further enhanced if there is a contrast in light and/or color between the spinning wheel and its background and/or foreground. To increase the width of the "window" or see-through viewing effect when a wheel is spun, perforations are usually designed to overlay each other. Abrasive sanding wheels that make use of this phenomenon are shown, for example, in U.S. Pat. Nos. 6,159,089; 6,077,156; 6,062,965; and 6,007,415; which are fully incorporated by reference herein.

Because of the presumed catastrophic consequences of monolithic resin/grain composite wheel breakage and/or protrusions into large apertures, the use of such "windows" to date has been limited to multiple component metallic-bodied cutting blades and/or flexible sanding wheels.

Thus, a need exists for an improved tool and/or method for surface grinding.

SUMMARY OF THE INVENTION

According to an embodiment of this invention, an abrasive wheel is provided for operational rotation about its axis to remove material from a workpiece. The abrasive wheel includes a mounting aperture, an abrasive grain-containing matrix, and a periphery that defines a notional cylinder during the operational rotation. The wheel includes at least one void extending axially through the matrix, so that during the operational rotation the void defines a notional window through which the workpiece may be viewed. The wheel is also substantially monolithic, and has a flexibility in the range of about 1–5 mm in the axial direction in response to an applied axial load of 20N.

Another aspect of the present invention includes a method of fabricating an abrasive wheel that is operationally rotatable about its axis to remove material from a workpiece. The method includes providing an abrasive grain-containing matrix, and forming the matrix into a wheel. The method also includes forming at least one void extending axially through the matrix, so that during the operational rotation, the void defines a notional window through which the workpiece may be viewed. The wheel is formed as a monolith, and is sized, shaped, and formed to have a flexibility in the range of about 1–5 mm in the axial direction in response to an applied axial load of 20N.

In a further aspect of the invention, an abrasive wheel is provided for operational rotation to remove material from a workpiece. The abrasive wheel includes a mounting aperture, an abrasive grain-containing matrix, and a periphery that defines a notional cylinder during the operational rotation. A plurality of voids extend axially through the matrix, so that during the operational rotation, the voids define a notional window through which the workpiece may be viewed. The plurality of voids include at least one viewing hole, and at least one unobstructed gap extending radially inwardly from the margin of the notional cylinder. The wheel is substantially monolithic.

The above and other features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figure 1:
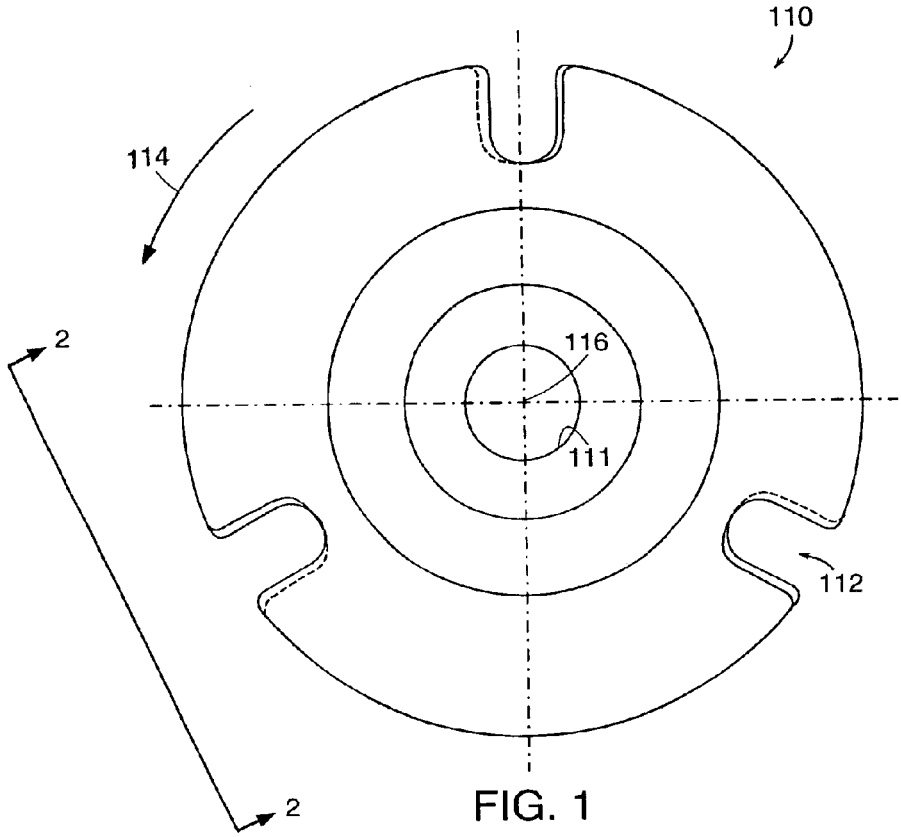
FIG. 1 is a bottom (grinding face side) plan view of a shaped perimeter grinding wheel of the subject invention.

Referring to the figures set forth in the accompanying Drawings, the illustrative embodiments of the present invention will be described in detail hereinbelow. For clarity of exposition, like features shown in the accompanying Drawings shall be indicated with like reference numerals and similar features as shown in alternate embodiments in the Drawings shall be indicated with similar reference numerals.

As used herein, the term "Wheel" refers to a monolithic (defined below) article, which is adapted for mounting on a rotatable spindle or arbor. It is not limited herein to purely circular or cylindrical shapes. It includes articles capable of use with a surface grinder or angle grinder.

The terms "gap" and "slot" interchangeably refer to an indentation or recess that extends completely through an object in at least one direction, while being incompletely surrounded by the material of the object. They include configurations in which the circular outer edge of a wheel is missing a segment, (defined below) or portion thereof, or appears to have been obtained by (notionally) moving an "aperture" until a portion of the aperture extended beyond the edge.

Similarly, "hole" includes an indentation, recess, or aperture, regardless of the specific shape or geometry thereof, that extends completely through an object in at least one direction, while being completely surrounded by the material of the object.

"Gaps", "slots", and/or "holes", are collectively referred to herein as "voids".

"Monolithic" and/or "monolith" refers to an object formed as a single, integral unit, such as by molding (e.g., casting). Examples of monolithic grinding wheels include both unreinforced and reinforced bonded abrasive grinding wheels. Examples of typical reinforcement include fibers such as glass or carbon, or a support plate, formed as a discrete layer of the grinding wheel, i.e., by molding the layer in-situ with the bond and abrasive material. Alternatively, the reinforcement may include fibers or other materials mixed substantially homogeneously with the bond and abrasive material. As used herein, "monolithic" and "monolith" specifically exclude conventional sanding discs that include a sheet of sandpaper removably fastened to a backing plate, and also exclude metal wheels having a layer of abrasive grain brazed or electroplated onto the rim of the wheel.

"Grinding" is used herein to refer to any abrading or finishing operation in which the surface of a workpiece is treated to remove material or alter the roughness.

"Segment" means a portion of a circle that lies between the perimeter and a chord.

"Axial" or "axial direction" refers to a direction that is substantially parallel to the axis of rotation of a wheel. Similarly, "transverse", "transverse direction" or "transverse plane" refers to a direction or plane that is substantially orthogonal to the axial direction.

The term "margin" includes the radially outermost edge and/or surface of a wheel or notional cylinder formed by rotation of a wheel. The margin of a wheel includes any gaps or slots disposed therein.

The term "periphery" of a wheel includes all the exterior surfaces of a wheel, including the margin, grinding face, and opposite (e.g., non-grinding) face.

Figure 22:
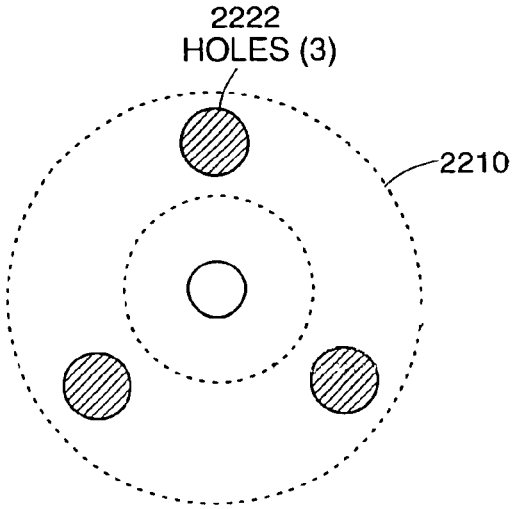
FIGS. 22–25 are views similar to that of FIG. 1, of additional embodiments of the present invention.
Figure 23:
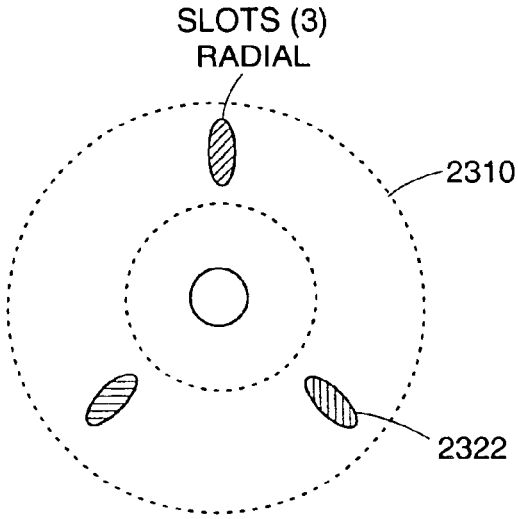
Figure 24:
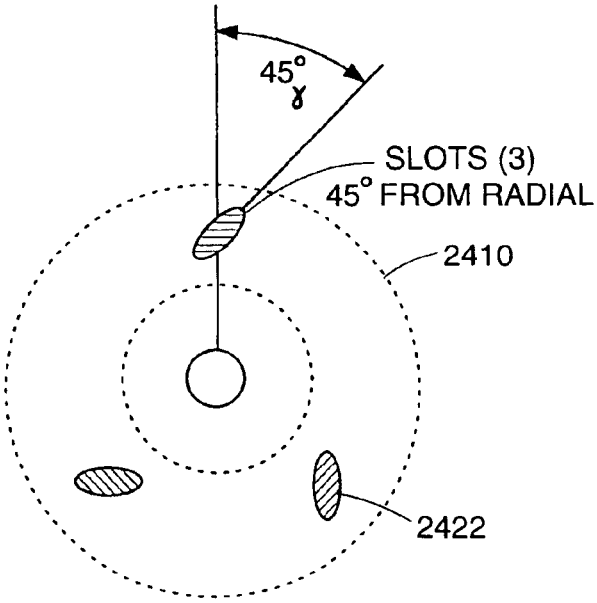

Briefly described, as shown in the Figs., the invention includes a monolithic abrasive grinding wheel having an irregular (i.e., gapped) perimeter shape and/or a series of holes extending therethrough, to permit one to view the surface of a workpiece being ground in conventional surface finishing, snagging and/or weld blending operations typically associated with face or surface grinding operations. As shown, for example, in FIGS. 1–4, the grinding wheels (110, 310 and 410) each include one or more gaps 112, 312 and 412 disposed in spaced relation about the otherwise circular perimeter of the wheel. These wheels may also include viewing holes, such as holes 322 shown in phantom in FIG. 3. Alternatively, the wheels may be provided with holes, without any peripheral gaps, such as shown in FIGS. 22–24. Referring to FIGS. 1 and 22, three gaps 112 or holes 2222, equidistant from the center may be used, but many other combinations are possible. The gaps and/or holes may be configured in many diverse shapes, and may be radiused (e.g. chamfered) to avoid the use of sharp or narrow corners and reduce any tendency for propagation of cracks. Gap and/or hole positions may be selected so as to retain the balance of the wheel. The wheels may be balanced dynamically by removing material from gap edges.

The gaps and/or holes permit the wheels to become semi-transparent when spun about their axes 116, 316 and 416 at a moderate to high speed due to the aforementioned "persistence of vision" effect. Thus, when the wheels are rotated about their axes, such as in the direction indicated by arrows 114, 314 and 414, an individual or machine (i.e., a grinding machine operator or a machine vision system) will be able to monitor the condition of the surface of the workpiece as it is being abraded, without removing the grinding wheel from the surface. It is suspected that the gaps and/or holes may also advantageously serve to improve air flow and to reduce the frictional area of contact so as to allow the surface of the workpiece to stay significantly cooler than when a prior art circular perimeter grinding wheel is used.

Gaps and/or viewing holes have been provided in conventional sanding discs, i.e., those that use a generally circular sheet of sandpaper fastened to a substantially rigid backing, such as disclosed in the above-referenced '521 Publication. However, they have not been utilized in monolithic bonded abrasive grinding wheels. Due to the relatively high concentration of stresses generated near the center of the wheel during grinding operations, it was suspected that providing apertures that extend through such wheels would generate an unacceptable loss of wheel strength. However, it has been discovered that with the proper wheel designs it is possible to place viewing apertures (i.e., holes) in the flat, grinding surface of these wheels.

Moreover, fears as illustrated by what is available in the prior art, i.e., that gaps in the perimeter might entrap projections from the work surface, or may generate stress concentrations that would ultimately cause the wheel to fail, have been shown to be unfounded in trials. As will be discussed in greater detail hereinbelow with respect to FIG. 10, the relatively high rotation speed together with optionally raking the gaps and/or raising the trailing edges 120 of the gaps 112 and/or holes 322, 622, etc., appears adequate to prevent a projection from entering the gaps of a wheel spinning at conventional rotational speeds.

Observations made during the use and development of the present invention indicate that an increase in efficiency and performance in grinding operation may be achieved, in part, by the creation of air turbulence between the spinning abrasive surface and the work surface or material being abraded to generate a cooling effect. There may also be a benefit from intermittent cutting—allowing a small measure of time to elapse between cutting intervals. There is a "rest time" occurring several times during each revolution of one of our improved grinding wheels. It has been determined that the best results are achieved by disposing gaps at equidistantly spaced locations about the margin of the wheel, so that the wheel is nominally evenly balanced.

Referring to the Figures, grinding wheels of the present invention will now be described in greater detail. With the exception of the gaps and/or holes, the wheels may be fabricated as industry standard organic or inorganic bonded abrasive wheels, in the aforementioned Types 1, 2, 5, 7, 10–13, 20–26, 27, 27A, 28, and 29. The wheels may also be fabricated as hybrids of Type 27 and Type 28 wheels such as those shown and described herein with respect to FIGS. 15–19 (referred to hereinbelow as "hybrid Type 27/28" wheels). These wheels also may be fabricated with or without conventional fiber or support plate reinforcement, and with conventional diameters. Examples of organic bond material include resin, rubber, shellac or other similar bonding agent. Inorganic bond material includes clay, glass, frit, porcelain, sodium silicate, magnesium oxychloride, or metal. Conventional grinding wheel fabrication techniques may be used, such as, for example, molding. Specific examples of conventional grinding wheel fabrication techniques as modified in accordance with the present invention are discussed in greater detail hereinbelow.

Figure 2:
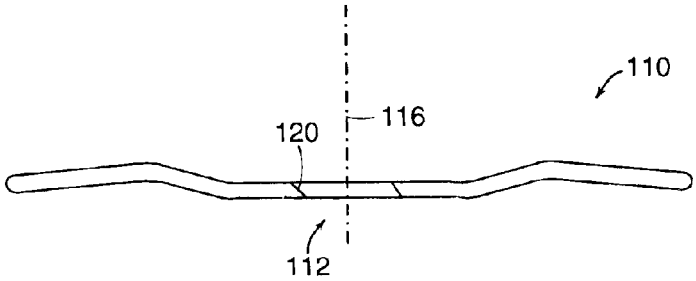
FIG. 2 is an elevational side view taken along 2—2 of FIG. 1.

A typical configuration of a wheel of the present invention is shown in FIGS. 1 and 2. FIG. 1 is a bottom view, i.e., a view looking at the flat grinding face of the wheel. As shown, the wheel 110 includes three gaps 112 and a conventional central mounting hole 111.

Figure 6:
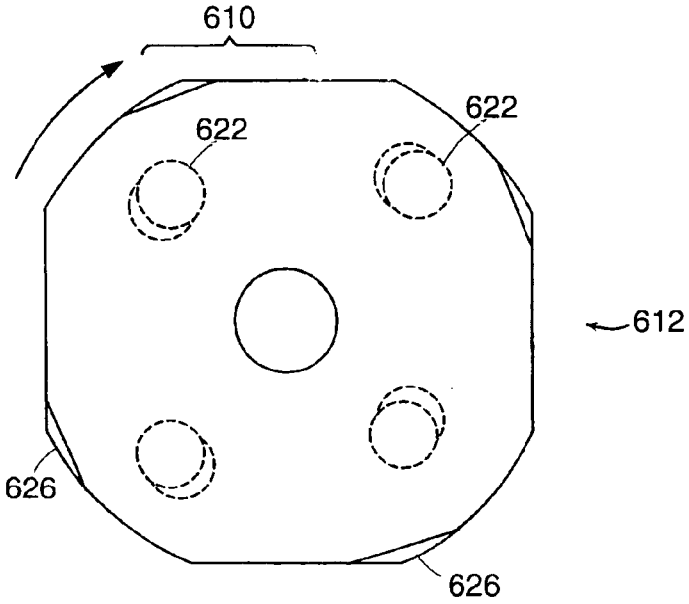
Figure 7:
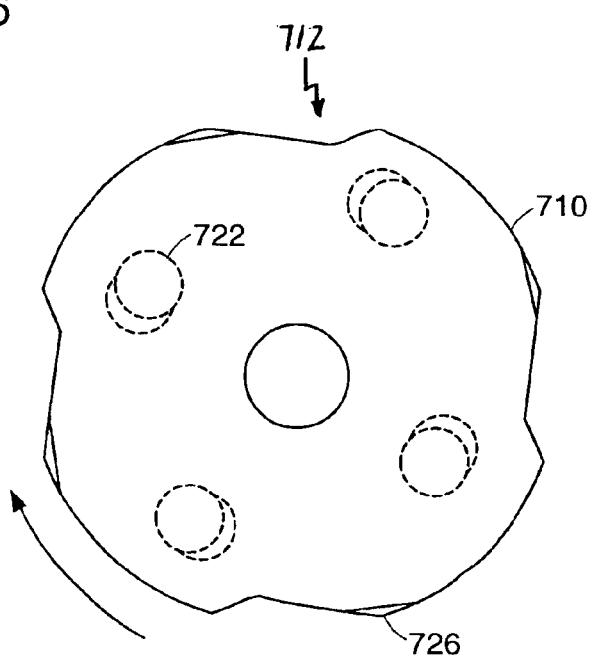
Figure 8C:
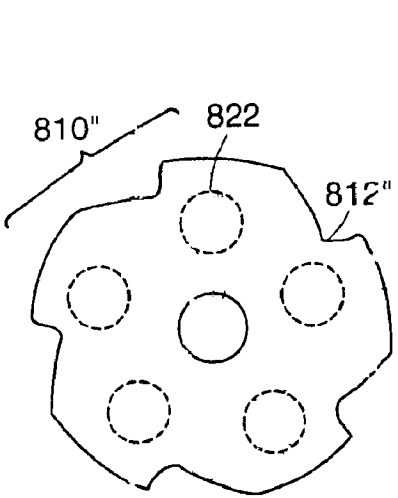
Figure 8B:
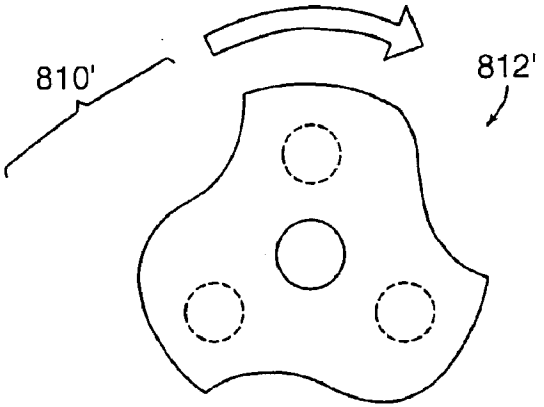

The gaps may be configured in any number of sizes and shapes, and in any reasonable number. For example, various three-gapped wheels are shown in FIGS. 1–5, 8 & 9. Four-gap embodiments are shown in FIGS. 6 & 7 and a five-gap version is shown in FIG. 8*c*. A one-gap wheel (with a balancing segment removed from an edge) (not shown) may also be used.

Figure 3:
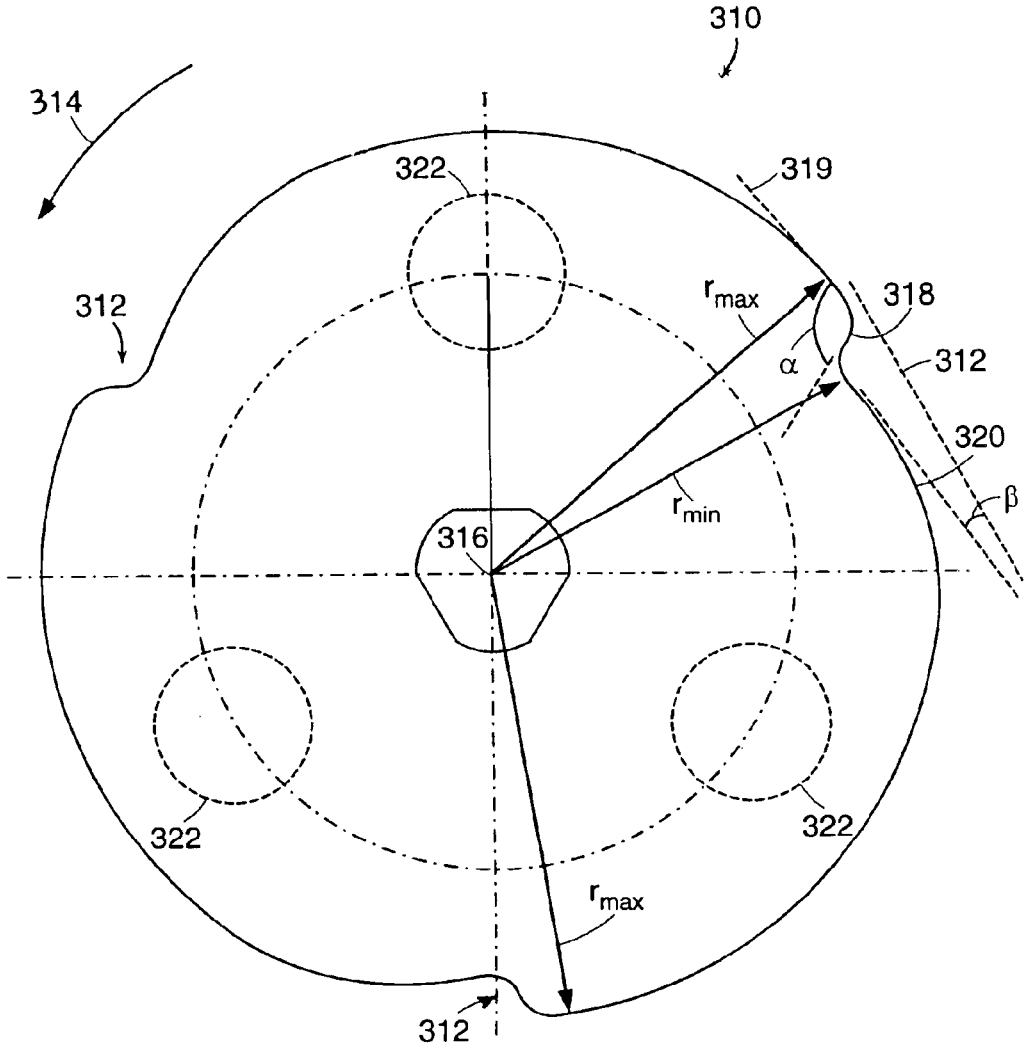
FIGS. 3–9 are views similar to that of FIG. 1, of various alternate embodiments of a grinding wheel according to the present invention, with optional through-holes shown in phantom.

Turning now to FIG. 3, gaps 312 may be asymmetrical to provide the wheel 310 with a generally stepped or scalloped perimeter. As shown, the gaps 312 include a leading edge 318, which extends radially inward from an outermost wheel radius $r_{max}$ at a relatively steep angle $\alpha$ (i.e., substantially orthogonal) relative to a tangent 319 at $r_{max}$. Leading edge 318 fairs into a trailing edge 320 having an initial radius $r_{min}$, which gradually fairs (i.e., at a relatively small, decreasing tangential angle $\beta$) into the outermost radius $r_{max}$. This graduated radius of the trailing edge 320 advantageously tends to reduce the likelihood of the wheel becoming caught on sharp edges, etc., of a workpiece. This graduated radius may also be used in combination with raising the trailing edge out of plane with the grinding face, as discussed hereinbelow with respect to FIG. 10.

Figure 4:
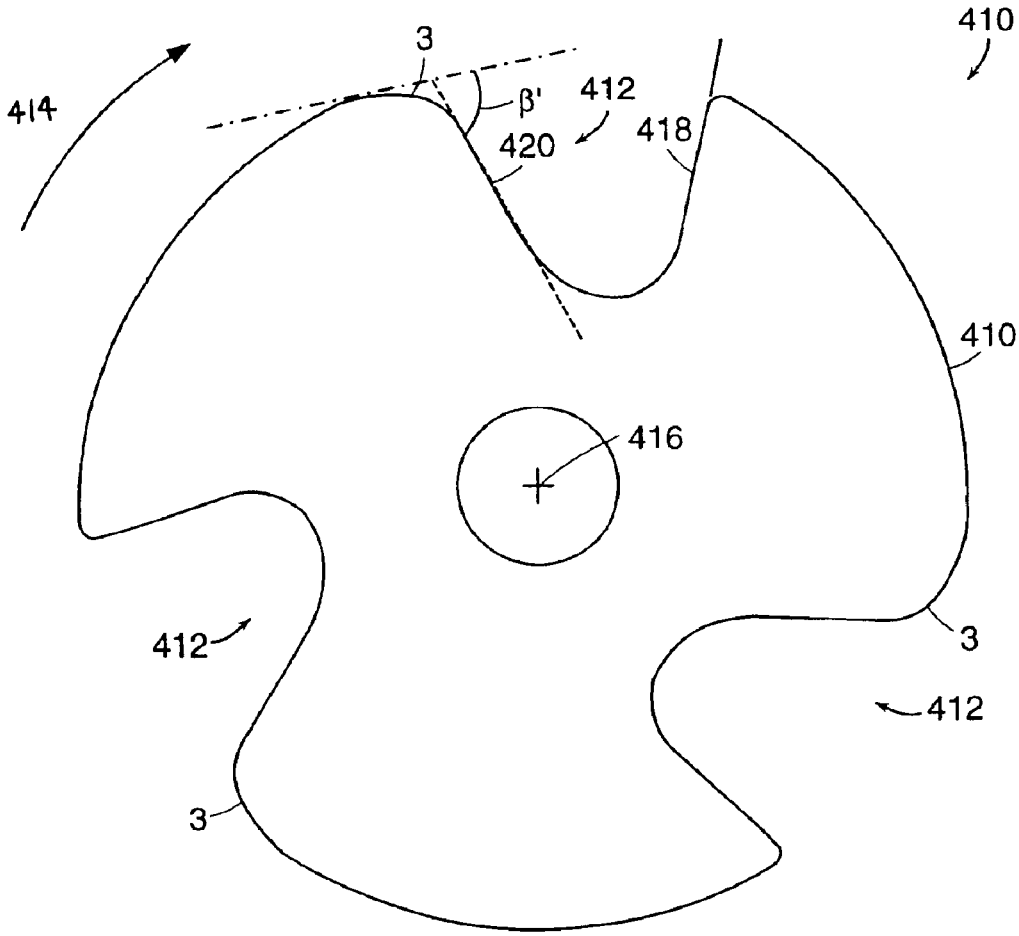

Turning to FIG. 4, a variation of the assymetrical gaps is shown. In this embodiment, wheel 410 is provided with gaps 412 that provide the wheel with a generally sawtooth-like perimeter. In a manner similar to that of wheel 310, the trailing edge 420 of wheel 410 preferably extends at an angle $\beta'$ that is less than 90 degrees.

Figure 5C:
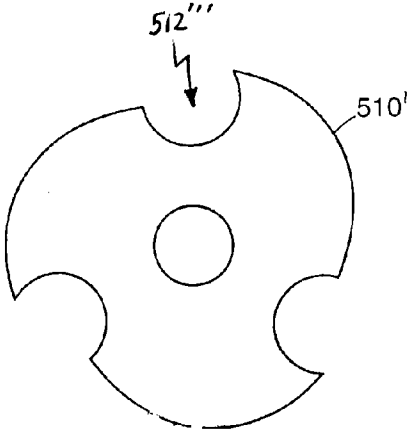
Figure 5B:
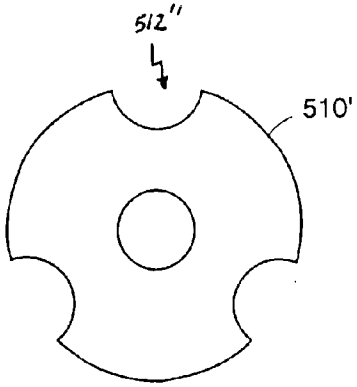
Figure 5A:
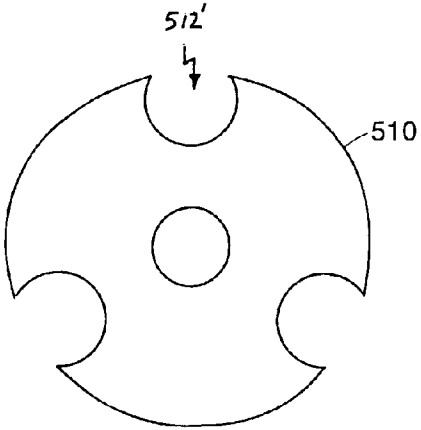

FIG. 5 includes two additional variations of symmetrical gaps 512' and 512" (FIGS. 5*a* & 5*b*), and another embodiment having assymetrical gaps 512'" (FIG. 5*c*).

FIGS. 6–9 show further embodiments of wheels (610, 710, 810, 810', 810" and 910) having gaps (612, 712, 812, 812', 812" and 912, respectively) defined as missing or removed segments of the wheel. These segments may be straight (612 and 812), curved (812') or sawtooth-like (812" and 912). There may be from one segment upwards; while three or four are preferred, and five (see 810") or more are feasible.

In addition, the edges of the grinding face along the trailing edge of the gap may be provided with chamfered edge portions (also referred to herein as 'wing tips') as at 626, 726, 826, and 926. These wing tips which may increase airflow between the wheel and the material being abraded, as well as reduce the impact of rim contact in a manner similar to that of the raised trailing edges of FIG. 10. The wing tips may further include deliberately formed vanes on the edge of the wheel, which may be used to direct or channel air about the circumference of the sanding wheel. These may be used in conjunction with an air containment "skirt" around the guard of the angle grinder so that dust is ejected in one direction rather than in all directions. A dust or swarf collecting device may be installed so that a substantial proportion of the dust or swarf is retained.

Viewing

As discussed above, the gaps or slots (112, 312, 412 . . . ) in the wheel advantageously enable a user to see the workpiece to be abraded through the spinning wheel as he/she is using the grinder. In this regard, it is very useful to be able to see and monitor the abrading action while it is in progress. As also discussed, most grinding wheels do not allow viewing to occur during abrading. The anatomy of a conventional surface or angle grinder generally does not allow viewing through the outer portion of a spinning wheel, and the wheels of the present invention have been developed to overcome this drawback. If grinding is carried out with a conventional opaque wheel the operator has to make a series of test abrasions, each time removing the tool to view the result, and as the job nears completion these inspection pauses have to be more and more frequent. The job completion process is a kind of successive approximation, and there is a possibility that the abrading process will be taken too far. Using the present invention the operator may carry out an abrasion operation in one application of the tool to the work and there is little risk of abrading too far.

It may be surprising that the presence of these gaps and/or holes in the wheel does not (as one might expect) allow protruding objects to entangle with the gap and cause catastrophic disruption to the grinding process.

The wheels of the present invention are preferably colored black, in order to enhance visual contrast for a person looking through a spinning wheel and relying on persistence of vision to see the workpiece behind. This color is less obtrusive than white, which tends to result in a graying out of a view of a work surface seen through a white or other light-colored wheel. As a result, the work beneath the wheel can be viewed right up to the edge of the wheel, if the removed segment in one place overlaps with a gap in another part of the wheel, so the entire working portion of the wheel "greys out" during use.

Air Cooling

It is expected that there may be a detectable current of air emerging semi-tangentially around a spinning wheel made according to the invention and rotated at the typical 8000–11000 revolutions per minute typical of a 4.5 inch/115 mm angle grinder. It appears that the raked gaps generate significant air turbulence at the abrasive surface and swarf tends to be expelled radially outward.

Figure 10A:
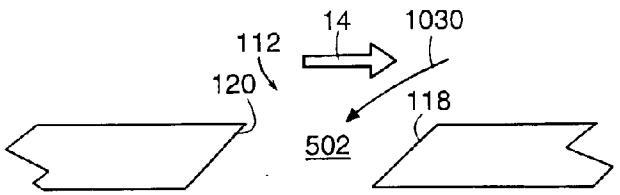
FIG. 10 is a view similar to that of FIG. 2, though in an inverted orientation and on an enlarged scale.
Figure 10B:
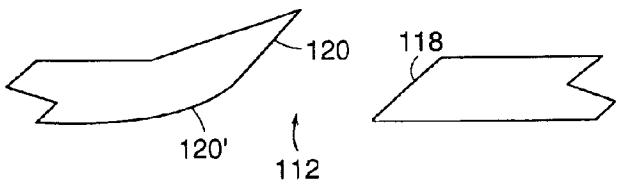

Turning now to FIG. 10, gap 112 (and/or the viewing holes discussed hereinbelow) may be raked as shown. For convenience, the following discussion will refer specifically to gaps, although it is to be understood that the discussion also fully applies to any of the viewing holes discussed herein. The preferred direction of rotation of the wheel 110 is indicated by the arrow 14 and the abrasive grinding face is downwards, as shown in the Figure. The leading edge 118 of a gap 112 is slanted (relative to the axial direction) to form an acute angle with the closest (i.e., adjacent) portion of the abrasive grinding face, while the trailing edge 120 is slanted so that an obtuse angle is formed relative to the adjacent portion of the grinding face. (Trailing surface 120' in FIG. 10*b* shows an additional raking shape, which may be used to further minimize the risk of the wheel catching a projection).

Even without an actual raking of the gaps themselves, there is generally significant and useful air turbulence generated by the motion of the apertures in the backing plate when the wheel spins at a high speed, which advantageously tends to cool the workpiece.

This effect may be increased by raking the gaps 112 as shown, since air tends to be carried to the surface of the workpiece as shown by arrow 1030 (FIG. 10*a*). This air flow may help cool the work, blow dust/swarf away from the site of abrasion, and remove broken-off abrasive particles from the working area. This effect may be further increased by raising the trailing edge 120' to form an air scoop as illustrated in FIG. 10*b*. There may well be significant air compression as the air reaches the surface being abraded. The air may also act as a kind of bearing, forcing itself between the spinning wheel and the stationary work in a manner analogous to an air bearing. In this case turbulence may be generated at the work surface that assists in swarf removal.

Even though we have observed that there is little likelihood of catching a projecting object at the trailing edge of a gap, or the like, (partly because there is a new gap presented during use (10,000 rpm) at about every 2 ms) the configuration shown in FIG. 10 tends to help minimize the risk (such as when the tool is slowing down) by providing a gentle slope for the object to glance off, rather than an abrupt corner.

In addition to those discussed hereinabove, the abrasive wheels of the present invention may be practiced in the form of various alternate embodiments. For example, as mentioned briefly above, any of the aforementioned wheels may be provided with one or more viewing holes 322, 622, 722, etc. shown in phantom in FIGS. 3, 6 and 7, etc., either in addition to, or in combination with the gaps or slots (112, 312, 412 . . . ). Additionally, the present invention may include viewing holes without using any peripheral gaps, such as wheels 2210, 2310 and 2410 of FIGS. 22–24 and as disclosed in the above-referenced Provisional Application (the '478 application) and in Japanese Patent Application No. 11-159371 entitled Offset Flexible Grinding Wheel with Viewing Holes for Observation of Grinding Surfaces. These viewing holes may be of substantially any configuration, including circular (i.e., shown in FIGS. 3, 9 and 22) or non-circular (i.e., oval holes 2322 and 2422 of FIGS. 23 and 24). Referring now to FIGS. 23 and 24 in greater detail, in the event oval or oblong holes are used, the holes may be oriented in any desired orientation. For example, as shown in FIG. 23, the holes 2322 may be disposed with their longitudinal axes (in the transverse plane) extending in the radial direction. Alternatively, as shown in FIG. 24, the longitudinal axes may be disposed at an offset angle $\gamma$ to the radial direction. In the example shown, angle $\gamma$ is approximately 45 degrees. Tests have shown that wheels fabricated with oblong holes have substantially increased strength relative to similar wheels fabricated with circular holes of a diameter equal to the longitudinal dimension of the slotted holes. Moreover, orienting the slotted holes at an angle $\gamma$ of 45 degrees further enhanced the wheel strength, as discussed in greater detail in the Examples hereinbelow.

Figure 8A:
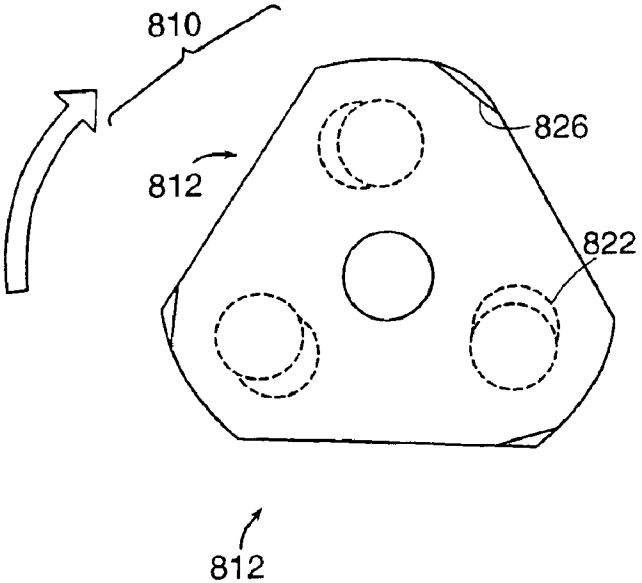
Figure 9:
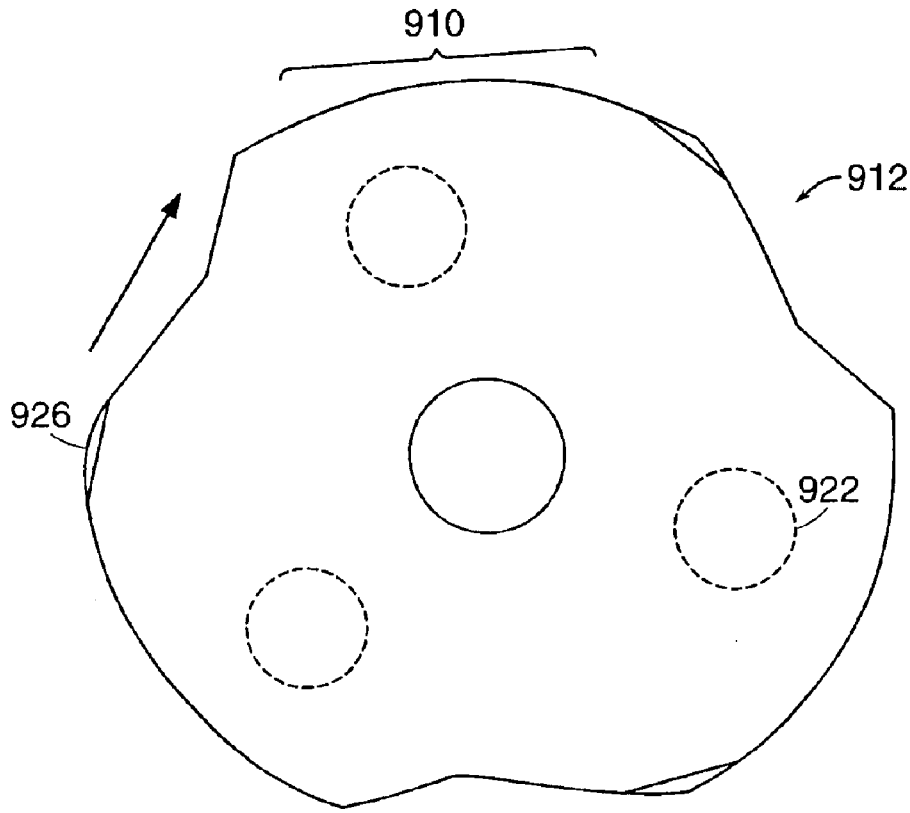
Figure 11:
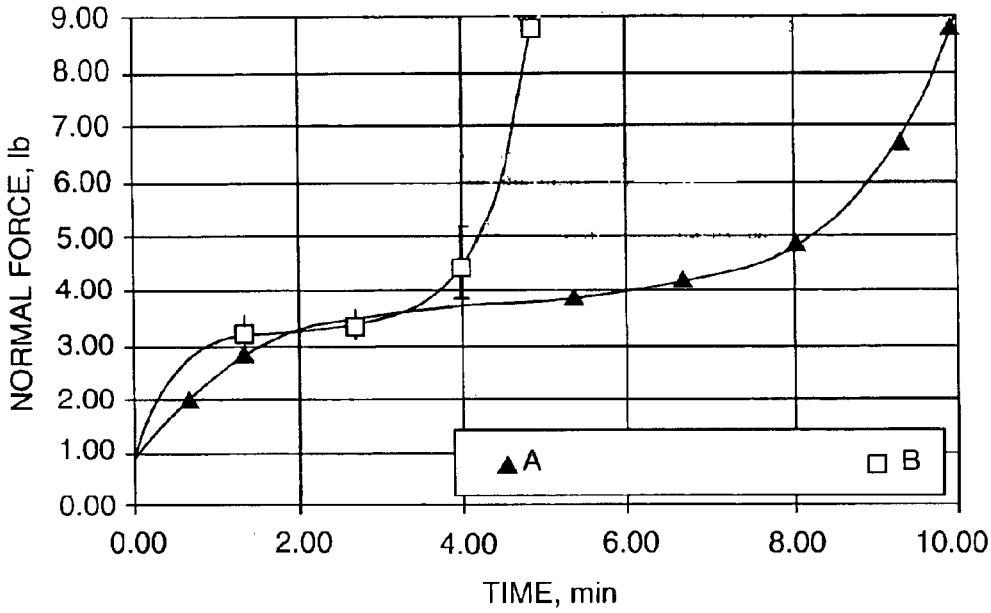
FIGS. 11–14 are graphs and a bar chart showing expected performance of various wheels of the prior art compared to the present invention.

In addition, any of the aforementioned viewing holes 322, 622, etc. may be raked as mentioned hereinabove with respect to FIGS. 2 and 10, and as shown in phantom in FIGS. 6, 7 and 8*a*. As also mentioned, the viewing holes operate substantially similarly to that of the aforementioned gaps to enable a user to view a workpiece therethrough during grinding operation.

The number and location of the hole(s) 322, 622, etc. are preferably selected so as to maintain balance of the wheel. Although is may be possible to provide a single viewing hole and shaping the wheel so as to maintain this rotational balance, it is generally preferable to provide a plurality of holes disposed in spaced relation about the axis of rotation of the wheels to provide the desired wheel balance. Any number of holes may be used, depending on the diameter of the wheel and the size of the holes. For example, wheels having an outermost diameter of 6 inches may include three to six holes, while larger diameter wheels (i.e., 9 to 20 inch wheels) may include 10 to 20 or more holes. The wheels may be balanced dynamically by removing material from the wheel margin. In particular exemplary embodiments, the viewing holes may be formed within an area between at least 60 percent of the radius of the notional cylinder defined by rotation of the wheel, and at least about 2 mm from the margin of the wheel.

Although the present invention may be embodied in substantially any type or configuration of grinding wheel, it is desirably implemented in those commonly known as "thin wheels" comprising abrasive grain contained in a bonding matrix, typically an organic resin matrix. As used herein, the term "thin wheel(s)" refer to wheels having a thickness t (in the axial direction), which is less than or equal to about 18% of the radius of the notional cylinder r (i.e., t< or =18% r.) Thin wheels include, for example, wheels having a thickness t ranging from about ⅛ inch up to about ¼ to ½ inch, depending on (outermost) wheel diameter. Examples of such thin wheels include the aforementioned Type 27, 27A, 28, 29, and hybrid Type 27/28 wheels. Types 27, 27A, 28, and 29 wheels are defined, for example, in ANSI Std. B7.1-2000. As mentioned hereinabove, hybrid Type 27/28 wheels are similar to Types 27 and 28, having a slightly curved axial cross-section, such as shown in FIGS. 16, 18, and 19, and described in greater detail hereinbelow.

As mentioned hereinabove, various fabrication techniques known to those skilled in the art of grinding wheel fabrication may be used and/or modified to produce embodiments of the present invention. Exemplary techniques that may be used are disclosed in U.S. Pat. No. 5,895,317 to Timm, and U.S. Pat. No. 5,876,470 to Abrahamson, which are fully incorporated by reference herein. Some exemplary fabrication techniques will now be described with reference to FIGS. 15–21. For brevity, most of these techniques are shown and described with respect to fabrication of hybrid Type 27/28 wheels having three viewing holes. However it should be clear to the skilled artisan that the techniques may be modified, including the size and shape of the mold and/or content of the mold mixture, to produce any of the wheel types described hereinabove, with any number of gaps and/or holes as described herein.

Figure 15:
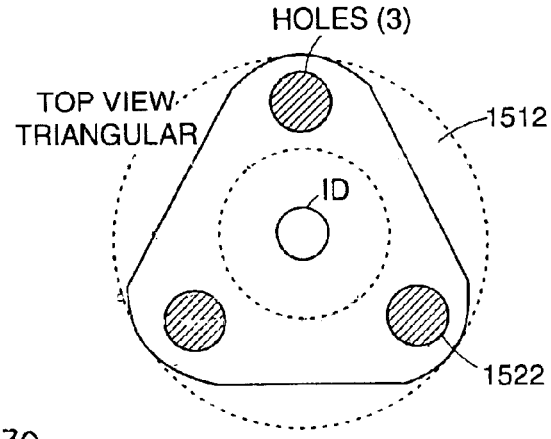
FIGS. 15 and 16 are plan and elevational side views, respectively, of an alternate embodiment of the present invention.
Figure 16:
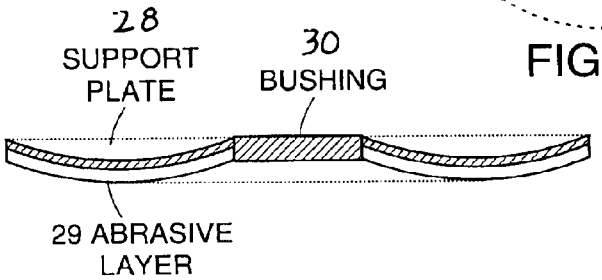

Turning to FIGS. 15 and 16, a hybrid Type 27/28 wheel 1510 may be fabricated by placing a support plate 28 into a suitably sized and shaped mold to form desired holes 1522 (FIG. 15) and/or gaps 1512 (as shown in phantom in FIG. 15). The support plate 28 may include a central bushing 30 integral to the plate, or may be a discrete member fastened thereto. (As shown, the support plate 28 and reinforcement layer 36 (FIG. 18) are slightly bowed in a known manner. Alternatively, these components may be substantially planar, such as for fabrication of Type 27, 27A and/or Type 28 wheels.) The holes of the plate 28 are receivably engaged with plugs (not shown), which are placed in the mold. The plugs are sized and shaped to form the desired holes. The mold is then filled with the desired abrasive and bond mixture to form abrasive layer 29. This mold-filling step may be accomplished using gravity feeding techniques, or alternatively, other techniques such as injection molding may be used. Heat and/or pressure may then be applied. The wheel is then removed from the mold and separated from the plugs to reveal a wheel having desired holes 1522 and/or the gaps 1512. Other conventional steps, such as dynamic balancing of the wheel, may then be completed.

Figure 17:
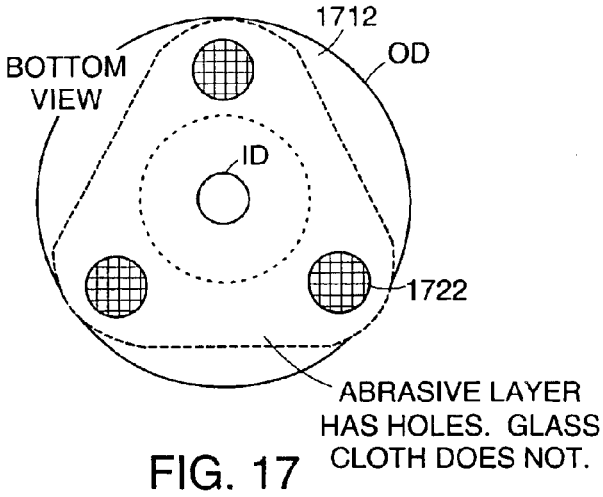
FIGS. 17 and 18 are plan and elevational side views, respectively, of another embodiment of the present invention.
Figure 18:
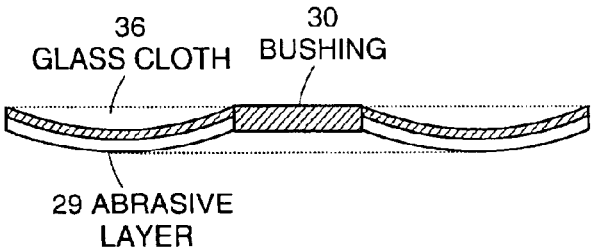
Figure 19:
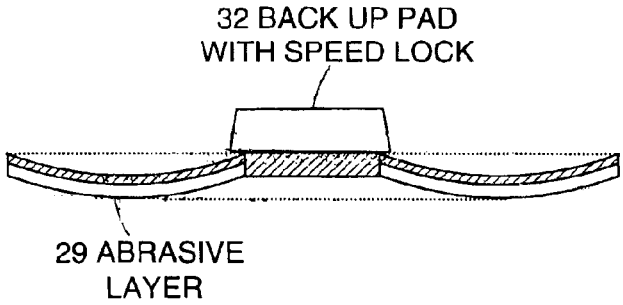
FIGS. 19–21 are elevational side views of additional embodiments of the present invention.

Turning now to FIGS. 17 and 18, a similar technique is used to fabricate a glass-reinforced wheel. As shown, a glass cloth 36 is placed in-situ in the mold. The cloth is preferably provided with a perimeter size and shape to match that of the mold (including any gaps 1712 (FIG. 17). Plugs are placed in the mold at the location of desired holes 1722 (FIG. 17). Subsequent steps are completed as described hereinabove with respect to FIGS. 15 and 16. The cloth layer may be cut at one or more of the voids holes to facilitate unobstructed viewing therethrough. Optionally, the cloth layer (glass layer or similar fabric reinforcement) may extend continuously across one or more of the voids (such as across the holes 1722 as shown) to provide structural reinforcement while also permitting a user to see through the layer due to its relatively open weave.

Turning to FIG. 19, either of the aforementioned fabrication approaches may be modified by applying a conventional back-up pad 32 with a speed lock device to the support plate or reinforcement layer before or after curing the wheel.

Figure 20:
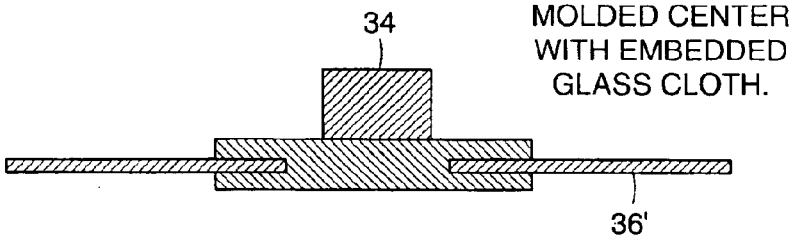
Figure 21:
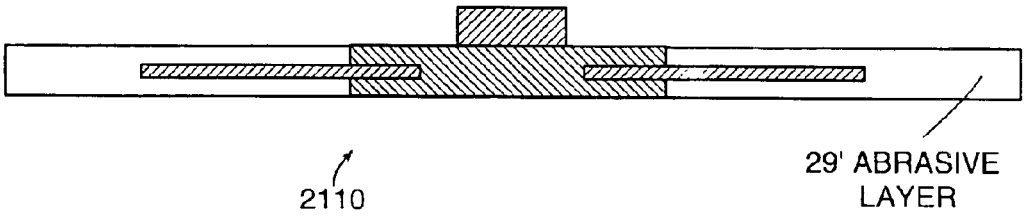

As a still further alternative, a molded center or hub 34 may be preformed with an embedded glass cloth or similar reinforcement layer 36', as shown in FIGS. 20 and 21. This assembly may be fabricated in any known manner, including molding and/or mechanical assembly operations. The hub/glass assembly then may be molded in-situ by placement in a mold, followed by insertion of the abrasive/bond mixture and application of heat and pressure, etc., as described above, to form a wheel 2110 having an integral hub 34 and a reinforced abrasive layer 29'. Although wheel 2110 is shown as a conventional straight wheel, it may alternatively be fabricated as a hybrid Type 27/28 wheel having a slightly curved transverse cross-section such as shown in FIGS. 16, 18 and 19.

Although embodiments of the present invention are shown as being fabricated with one reinforcement layer 36, 36', additional layers 36, 36' may also be used. For example, one layer 36, 36' may be disposed internally, with another layer disposed on an external surface of the wheel. In the event a fiberglass cloth layer 36, 36' is used, the (uncoated) cloth may have a weight (conventionally referred to as griege weight) within a range of about 160 to 320 grams per square meter (g/sq. m). For example, in the event one layer of cloth is used, for wheels having a thickness range of about 1/16–¼ inch (about 2–6 mm), cloth having a medium (230–250 g/sq m) to heavy (320–500 g/sq m) griege weight may be used. In the event two or more layers 36, 36' are used, one or both may be light weight (about 160 g/sq m).

The following illustrative examples are intended to demonstrate certain aspects of the present invention. It is to be understood that these examples should not be construed as limiting.

EXAMPLES

Example 1

In this Example, two wheels are compared for grinding performance. The first wheel, (B), is a prior art wheel with a diameter of 11.4 cm (4.5 inches) with a central mounting aperture used in the typical prior art fashion. The second wheel, (A) is identical to the (B) wheel but modified according to the invention by removing straight segments from the perimeter to provide a wheel as shown in FIG. 8*a* of the drawings. The wheel is fabricated from 50 grit fused alumina abrasive grain bonded within a phenolic resin, and an integral fiberglass cloth reinforcement layer.

The wheels are evaluated using an Okuma ID/OD grinder used in an axial-feed mode such that the workpiece was presented to the face of the wheel rather than an edge.

The workpiece used is 1018 mild steel in the form of a cylinder with an outside diameter of 12.7 cm (5 inches) and an inside diameter of 11.4 cm (4.5 inches). The end surface is presented to the abrasive wheel. The abrasive wheels are operated at 10,000 rpm and an in-feed rate of 0.5 mm/min is used. The workpiece is rotated at about 12 rpm. No coolant is used and the workpiece is centered on the portion of the wheel where the viewing gaps are located in the embodiments according to the invention. The wheels are weighed before and after the testing.

To determine a reference point, the workpiece is brought into contact with the wheel until the axial force reaches 0.22 kg (1 pound). Grinding is then continued from this reference point until the axial force reaches 1.98 kg (9 pounds), which is taken to correspond to the end of the useful life of the wheel. Thus the time of grinding between the reference point and the end point is considered to be the useful life of the wheel.

The results are represented graphically in FIGS. 11–14. From FIG. 11 it can be seen that the rapid rise to a normal force of 9 pounds, which is taken to be the end point since at that point little metal removal is occurring since most of the abrasive grit has been removed or worn out, occurs substantially later for the wheel A with the modified triangular shape. This wheel lasts about twice as long as the other wheel. This is counterintuitive since more of the abrasive surface has been removed.

Figure 12:
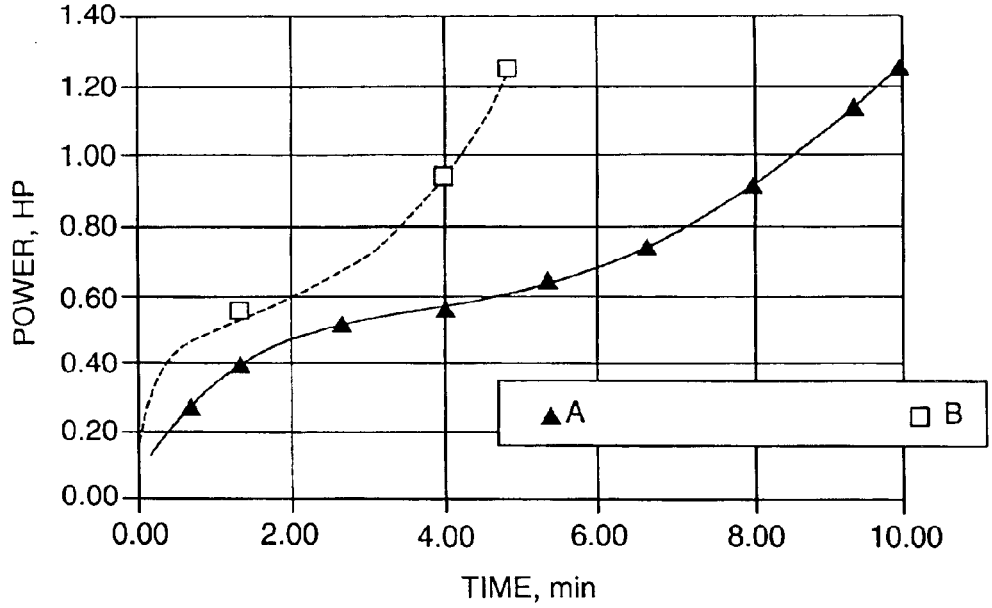

In FIG. 12, the power drawn by each of the wheels is plotted as a function of time. This shows the same pattern as FIG. 11 with the wheel A drawing significantly less power throughout the period when the wheels are actually grinding. Thus wheel A requires less force and draws less power.

Figure 13:
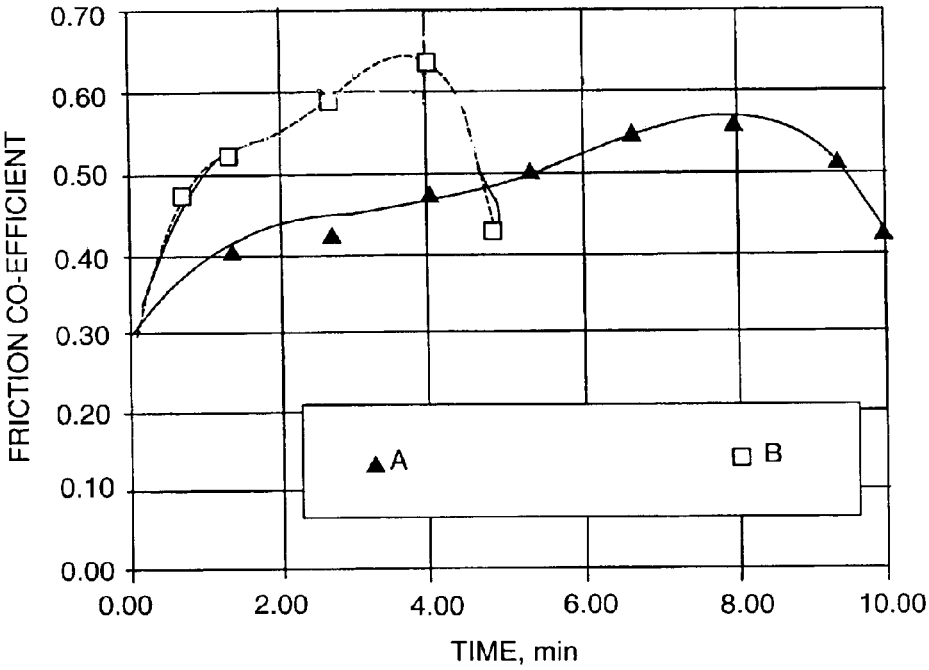

In FIG. 13, the friction coefficient variation with time is plotted for the wheels. The lowest coefficient is observed with wheel A.

Figure 14:
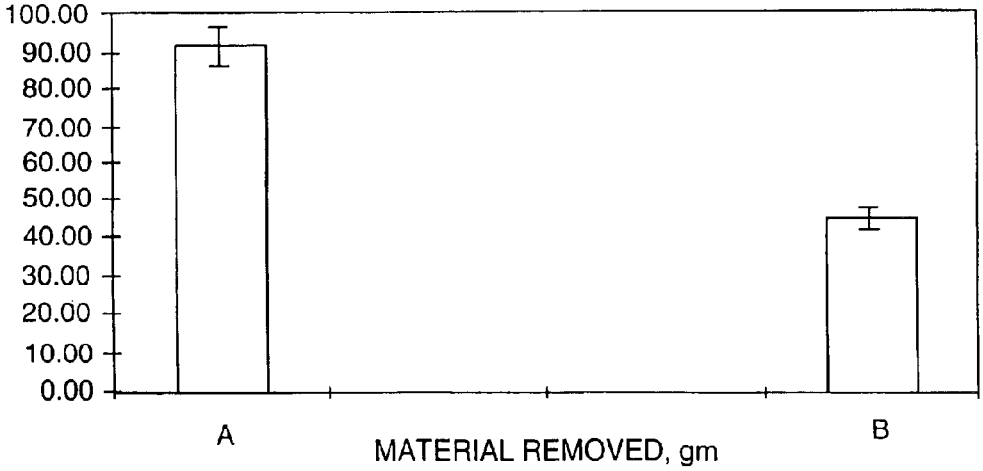

FIG. 14 compares the amount of metal cut over time by the wheels. This shows that wheel A cut about twice as much material as wheel B.

Thus exemplary wheels according to the invention are expected to cut at least as well as the prior art wheels while affording the benefit of being able to view the area being abraded as the abrading progresses rather than between abrading passes. This is obtained even though the amount of abrading surface is reduced by provision of the viewing gaps. Moreover, this advantage provides improved vision of the surface of the workpiece right up to the edge of the abrading wheel, while cutting more metal, at a lower power draw, and over a longer period. This is both counter-intuitive and highly advantageous.

Example 2

Examples of Type 27 wheels were fabricated substantially as shown in FIGS. 22, 23, and 24, i.e., with circular, radially oblong holes, and obliquely oblong holes, respectively. The oblong holes were provided with an aspect ratio (length to width) of about 2:1 in the transverse plane, i.e., the longitudinal dimension of the oblong holes was about twice that of the dimension orthogonal thereto in the transverse plane. The wheels of FIG. 22 exhibited a push-out strength of about 80 percent of a conventional control wheel without holes, while the wheel of FIG. 23 exhibited a push-out strength of 87 percent of the control. The wheel with the obliquely oriented holes of FIG. 24 exhibited a still greater push-out strength of 95 percent of that of the control wheel. Push-out strength was measured using conventional ANSI testing specifications for maximum center load from lateral force stress, such as described in U.S. Pat. No. 5,913,994, which is fully incorporated by reference herein. Briefly described, the push-out strength test included a conventional ring on ring strength test in which the wheel was mounted on a conventional center flange, and the margin of the wheel was supported by a ring. An axial load was applied to the flange at a loading rate of 0.05 inches/minute using a conventional testing machine. The load was applied to the wheel flange from zero load until catastrophic wheel failure (e.g., wheel fracture).

Example 3

Figure 25:
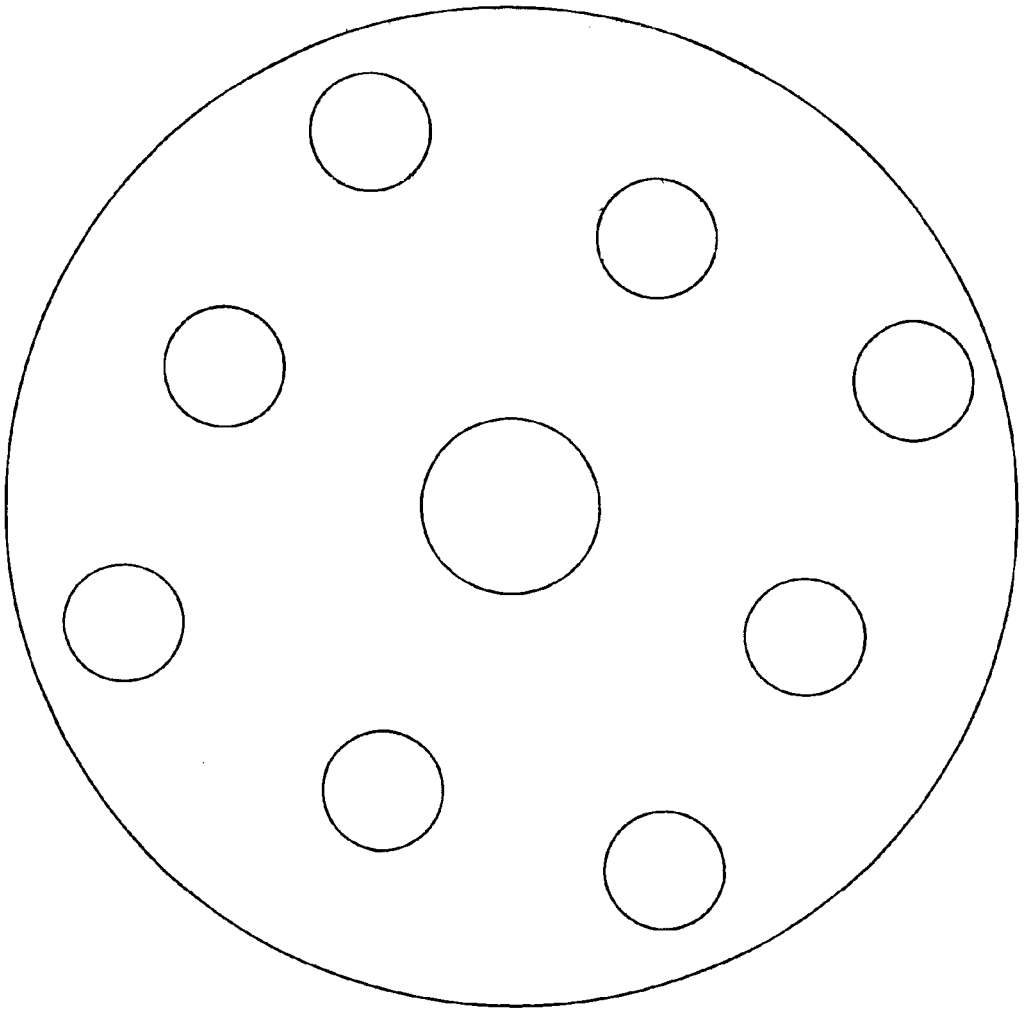
Figure 26:
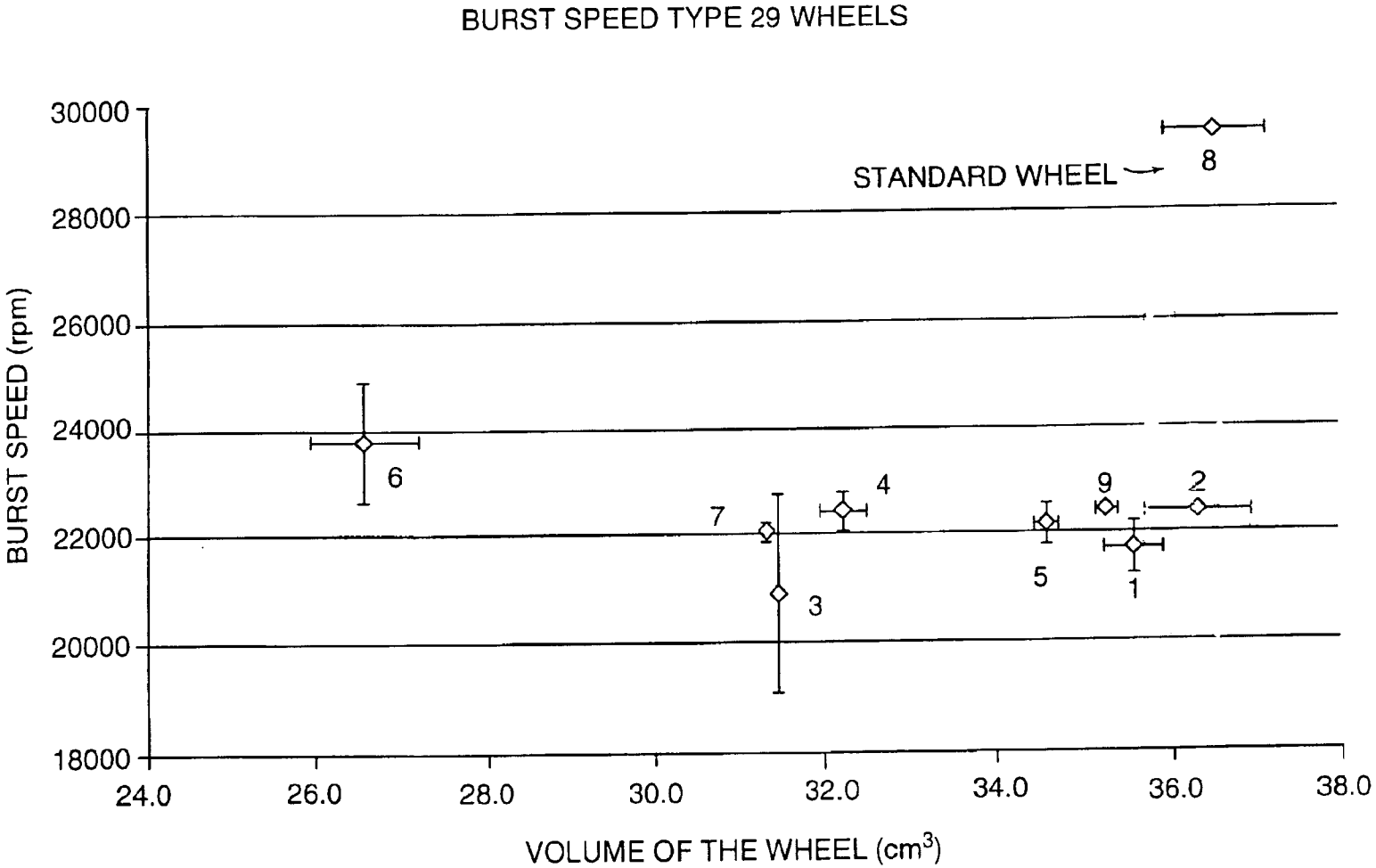
FIG. 26 is a graphical representation of test results of various embodiments of the present invention compared to prior art wheels.

Additional test samples were fabricated as hybrid Type 27/28 wheels substantially as shown in FIGS. 1, 3, 22, and 25, (forming notional cylinders) of 5 inch (12.7 cm) diameter. Each of the wheels also included a fiberglass cloth layer 36, such as shown in FIG. 18, having an uncoated griege weight within a range of about 230–250 g/sq m. Nine wheel variations (Variations 1–9) were fabricated with a ⅛ inch (3 mm) thickness and a ⅞ inch (2.2 cm) center hole. These wheel variations were tested for flexibility and burst strength. The results of these tests are shown in FIG. 26 and in Table I hereinbelow.

In these examples, wheel variation 1 was fabricated substantially as shown in FIG. 22, with three equidistantly spaced holes 2222 of about ¾ inch (1.9 cm) diameter, extending no closer than about ⅜ inch (0.9 cm) from the margin of the wheel. Wheel variation 2 was substantially similar to wheel variation 1, with holes of about ⅜ inch (0.9 cm). Wheel variation 3 was substantially similar to wheel variation 1, while having six equidistantly spaced holes 2222. Wheel variation 4 was substantially similar to wheel variation 1, while having slots 112 instead of holes, such as shown in FIG. 1. These slots 112 extended about ⅞inch (2.2 cm) radially inward from the margin, with a width of about ⅜ inch (0.95 cm). Wheel variation 5 was substantially similar to wheel variation 4, while having slots 112 of about ¾ inch (1.9 cm) in width. Wheel variation 6 was substantially similar to wheel variation 5, while having six equidistantly spaced slots 112. Wheel variation 7 was substantially similar to wheel variation 1 (including three holes), while having a scalloped margin as provided by gaps 312 shown in FIG. 3. Wheel variation 8 was a conventional prior art wheel, substantially similar to wheel variation 1 without holes 2222. Wheel variation 9 was substantially similar to wheel variation 2, while having 8 holes spaced along discrete concentric rings as shown in FIG. 25 and as described in the above-referenced '478 application. Three wheels of each variation 1–9 were fabricated and tested.

The flexibility of each of the wheels was measured as described in the above-referenced '478 application, by mounting the grinding wheel on a flange with a 15 mm radius and determining the flexibility as the elastic deformation (in millimeters) in the axial direction exhibited when an axial load of 20N is applied by a probe (having a contact tip of 5 mm radius) at 47 mm from the center of the grinding wheel with the wheel in a stationary state. (The deformation was similarly measured at the radial location of 47 mm from the center of the wheel.) The volume of each wheel was obtained by dividing the weight of the wheel by the density of the wheel material (2.54 g/cm$^3$). The volume and flexibility of each wheel variation 1–9 is shown in Table I, hereinbelow.

TABLE 1

| | Wt (g) | Ave. Wt | Std. dev | Wheel Volume | Std. dev. | Deflection [Meas.] | Std.dev |
|---|---|---|---|---|---|---|---|
| | | | | Deflection | | | |
| 1 | 86 | 88.9 | 2.6 | 35.0 | 1.0 | 2.67 | 0.4 |
| | 90.9 | | | | | | |
| | 89.7 | | | | | | |
| 2 | 91.1 | 91.1 | 2.2 | 35.9 | 0.9 | 3.67 | 0.3 |
| | 88.9 | | | | | | |
| | 93.3 | | | | | | |
| 3 | 79.6 | 79.3 | 0.7 | 31.2 | 0.3 | 4.50 | 0.7 |
| | 79.9 | | | | | | |
| | 78.5 | | | | | | |
| 4 | 82.1 | 82.7 | 1.9 | 32.6 | 0.7 | 3.50 | 0.7 |
| | 84.8 | | | | | | |
| | 81.2 | | | | | | |

TABLE 1-continued

| | Wt (g) | Ave. Wt | Std. dev | Wheel Volume | Std. dev. | Deflection [Meas.] | Std.dev |
|---|---|---|---|---|---|---|---|
| | | | | Deflection | | | |
| 5 | 84.5<br>87.5<br>88 | 86.7 | 1.9 | 34.1 | 0.7 | 2.94 | 0.5 |
| 6 | 68.5<br>64<br>66.3 | 66.3 | 2.3 | 26.1 | 0.9 | 5.94 | 0.8 |
| 7 | 77.4<br>79.4<br>79.4 | 78.7 | 1.2 | 31.0 | 0.5 | 4.11 | 0.3 |
| 8 | 97.4<br>91.6<br>93.7 | 94.2 | 2.9 | 37.1 | 1.2 | 3.22 | 0.2 |
| 9 | 88<br>89.3<br>89.7 | 89 | 0.9 | 35.0 | 0.3 | 3.78 | 0.6 |

These test results indicate that embodiments of the present invention may advantageously be sized and shaped so that the combined volume of holes and/or gaps (i.e., voids) as a percentage of the total volume of the wheel, remains below about 25 percent, and more preferably within the range of about 3–20 percent. (For convenience, this volume or volume percent may be referred to herein as the void volume or void volume percent, respectively.)

Each of the wheel variations tested, except for variation 6, exhibit a void volume percent below about 25 percent. Wheel variation 6 exhibited a void volume percent ranging from about 25 to 34 percent. The void volume percent was obtained by subtracting the volume of each wheel of variations 1–7 and 9 from the total volume of each wheel, dividing the result by the total volume of each wheel, and multiplying by 100. The total volume of each wheel is the volume of the wheel without any voids, i.e., the volume of the notional cylinder defined by each wheel during rotation thereof. For convenience, the volume of conventional wheel variation 8 (the variation without any voids) was used as the total volume in void volume calculations.

Maintaining the void volume percent below about 25 percent advantageously helps maintain wheel flexibility at about 5 mm or less, to facilitate face grinding operations. Specific embodiments of the present invention exhibit flexibility with a range of about 1–5 mm, with other embodiments exhibiting flexibility within a range of about 2–5 mm as indicated by the aforementioned test results.

Two wheels of each wheel variation were also burst tested by subjecting them to increasing rotational speeds (rpm) until wheel failure. These test results are shown in FIG. 26.

Advantageously, this testing indicated that all of the wheel variations exhibited a burst speed of at least about 21,000 rpm, or about 27,500 surface feet per minute "sfpm" (140 surface meters per second "SMPS"). SFPM and SMPS are given by the following equations (1) and (2):

$$\text{SFPM}=0.262\times\text{wheel diameter in inches}\times\text{r.p.m.} \quad (1)$$

$$\text{SMPS}=\text{SFPM}/196.85 \quad (2)$$

This aspect advantageously permits embodiments of the invention fabricated as 5 inch diameter hybrid Type 27/28 wheels to be operated on hand-held grinding machines that typically operate at a maximum speed of 16,000 rpm.

These test results also indicate (e.g., variation 3 compared to variations 4 and 7) that it may be advantageous to have at least some of the void volume disposed relatively close to the perimeter of the wheels, such as provided by the use of at least some gaps or slots. This may also be accomplished by locating any holes within the aforementioned range of radial positions (i.e., within an area between 60 percent of the notional cylinder radius and at least about 2 mm from the margin of the wheel.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. An abrasive wheel for operational rotation about its axis to remove material from a workpiece, said abrasive wheel comprising:

a mounting aperture;

an abrasive grain-containing matrix;

a periphery that defines a notional cylinder during the operational rotation;

at least one void extending axially through the matrix, wherein during the operational rotation, the void defines a notional window through which the workpiece may be viewed;

the wheel being substantially monolithic; and the wheel having a flexibility in the range of about 1–5 mm in the axial direction in response to an applied axial load of 20N.

2. The abrasive wheel of claim 1, wherein the flexibility is in the range of about 2–5 mm.

3. The abrasive wheel of claim 1, further comprising a void volume of less than about 25 percent of the volume of the notional cylinder.

4. The abrasive wheel of claim 3, wherein the void volume is in the range of about 3–20 percent.

5. The abrasive wheel of claim 1, wherein the void comprises at least one unobstructed gap extending radially inwardly from the perimeter of the notional cylinder.

6. The abrasive wheel of claim 5, wherein the void comprises at least one viewing hole.

7. The abrasive wheel of claim 6, wherein the viewing hole is disposed within an area defined by at least about 60 percent of the radius of the notional cylinder and at least about 2 mm from the margin of the wheel.

8. The abrasive wheel of claim 1, comprising a hub disposed integrally within said grain-containing matrix.

9. The abrasive wheel of claim 1, wherein said abrasive grain-containing matrix is an organic bond material.

10. The abrasive wheel of claim 9, wherein said abrasive grain-containing matrix is an inorganic bond material.

11. The abrasive wheel of claim 1, wherein said abrasive grain-containing matrix further comprises an integral reinforcement.

12. The abrasive wheel of claim 11, wherein said reinforcement comprises a fiber material dispersed within said abrasive grain-containing matrix.

13. The abrasive wheel of claim 11, wherein the fiber material comprises a cloth layer.

14. The abrasive wheel of claim 13, wherein the fiber material comprises a plurality of cloth layers.

15. The abrasive wheel of claim 13, further comprising a hub fastened to the cloth layer.

16. The abrasive wheel of claim 13, wherein the cloth layer extends across the void.

17. The abrasive wheel of claim 13, wherein said cloth layer comprises a layer of fiberglass having a griege weight within a range of about 160–500 grams per square meter.

18. The abrasive wheel of claim 11, wherein said reinforcement comprises a support plate.

19. The abrasive wheel of claim 5, wherein said gap is symmetrical.

20. The abrasive wheel of claim 19, wherein said gap is U-shaped.

21. The abrasive wheel of claim 19, wherein said gap is semi-circular.

22. The abrasive wheel of claim 5, wherein said gap is assymetrical.

23. The abrasive wheel of claim 22, wherein said gap comprises a trailing edge disposed at a smaller angle relative to the nearest tangent of said notional circle, than that of a leading edge of said gap.

24. The abrasive wheel of claim 1, wherein said void is raked relative to the axial direction.

25. The abrasive wheel of claim 24, wherein a leading edge of said void is disposed at an acute angle relative to an adjacent portion of a bearing surface of said abrasive grain-containing matrix.

26. The abrasive wheel of claim 24, wherein a trailing edge of said gap is disposed at an obtuse angle relative to an adjacent portion of the bearing surface.

27. The abrasive wheel of claim 5, wherein said gap comprises a segment of said notional circle.

28. The abrasive wheel of claim 27, wherein the segment is substantially curved along an edge thereof other than that of the notional cylinder.

29. The abrasive wheel of claim 27, wherein the segment is substantially straight along an edge thereof.

30. The abrasive wheel of claim 29, wherein an edge of said segment is defined by a chord of said notional circle.

31. The abrasive wheel of claim 5, further comprising a plurality of gaps disposed in spaced relation along the margin of the notional cylinder.

32. The abrasive wheel of claim 1, wherein said abrasive grain-containing matrix comprises a flat grinding face.

33. The abrasive wheel of claim 1, wherein the void comprises at least one viewing hole extending therethrough.

34. The abrasive wheel of claim 33, wherein said hole is circular in a transverse cross-section.

35. The abrasive wheel of claim 33, wherein said hole is raked relative to the axial direction.

36. The abrasive wheel of claim 33, further comprising a plurality of holes disposed in spaced relation about said wheel.

37. The abrasive wheel of claim 33, wherein said hole is disposed within an area defined by at least 60 percent of the radius of the notional cylinder and at least about 2 mm from the margin of the wheel.

38. The abrasive wheel of claim 33, wherein said hole is oblong in a transverse cross-section, wherein said hole has a longitudinal axis.

39. The abrasive wheel of claim 38, wherein said longitudinal axis extends along the radius of said wheel.

40. The abrasive wheel of claim 38, wherein said longitudinal axis is disposed obliquely relative to the radius of said wheel.

41. The abrasive wheel of claim 40, wherein said longitudinal axis is disposed at an angle of about 45 degrees relative to the radius of said wheel.

42. The abrasive wheel of claim 1, being fabricated as a wheel selected from the group consisting of Type 27, Type 27A, Type 28, hybrid Type 27/28, and Type 29 wheels.

43. The abrasive wheel of claim 1, having a burst speed of at least about 27,500 surface feet per minute (140 surface meters per second.).

44. A method of fabricating an abrasive wheel that is operationally rotatable about its axis to remove material from a workpiece, said method comprising:

a. providing an abrasive grain-containing matrix;

b. forming the matrix into a wheel;

c. forming at least one void extending axially through the matrix, wherein during the operational rotation, the void defines a notional window through which the workpiece may be viewed;

d. forming the wheel as a monolith; and e. sizing, shaping, and forming the wheel to have a flexibility in the range of about 1–5 mm in the axial direction in response to an applied axial load of 20N.

45. An abrasive wheel for operational rotation to remove material from a workpiece, said abrasive wheel comprising:

a mounting aperture;

an abrasive grain-containing matrix;

a periphery that defines a notional cylinder during the operational rotation;

a plurality of voids extending axially through the matrix, wherein during the operational rotation, the voids define a notional window through which the workpiece may be viewed;

the plurality of voids including at least one viewing hole, and at least one unobstructed gap extending radially inwardly from the perimeter of the notional cylinder; wherein the wheel has a flexibility in the range of about 1–5 mm in the axial direction in response to an applied axial loan of 20N, and the wheel being substantially monolithic.

46. The abrasive wheel of claim 45, wherein the flexibility is in the range of about 2–5 mm.

47. The abrasive wheel of claim 45, further comprising a void volume of less than about 25 percent of the volume of the notional cylinder.

48. The abrasive wheel of claim 47, wherein the void volume is in the range of about 3–20 percent.

49. The abrasive wheel of claim 1, wherein the notional cylinder has a thickness in the axial direction which is less than or equal to about 18 percent of the radius thereof.

* * * * *